US009281595B2

(12) United States Patent
Namjoshi et al.

(10) Patent No.: US 9,281,595 B2
(45) Date of Patent: Mar. 8, 2016

(54) SYSTEM AND CONNECTOR CONFIGURED FOR MACRO MOTION

(71) Applicants: Molex, LLC, Lisle, IL (US); Dow Global Technologies LLC, Midland, MI (US)

(72) Inventors: Abhijit Namjoshi, Midland, MI (US); Ronald C. Hodge, Aurora, IL (US); Jinjie Shi, Midland, MI (US); Joseph D. Comerci, Elmhurst, IL (US); Steven J. Rozeveld, Midland, MI (US); Timothy R. Gregori, Lockport, IL (US); Narayan Ramesh, Midland, MI (US); Karen Samiec, Downers Grove, IL (US); John C. McKeen, Hope, MI (US); James R. Keenihan, Midland, MI (US); David Parrillo, Midland, MI (US)

(73) Assignees: Molex, LLC, Lisle, IL (US); Dow Global Technologies LLC, Midland, MI (US)

( * ) Notice: Subject to any disclaimer, the term of this patent is extended or adjusted under 35 U.S.C. 154(b) by 87 days.

(21) Appl. No.: 13/628,228

(22) Filed: Sep. 27, 2012

(65) Prior Publication Data

US 2013/0084716 A1 Apr. 4, 2013

Related U.S. Application Data

(60) Provisional application No. 61/541,256, filed on Sep. 30, 2011.

(51) Int. Cl.

| | |
|---|---|
| ***H01R 13/44*** | (2006.01) |
| ***H01R 13/11*** | (2006.01) |
| *H01R 103/00* | (2006.01) |

(52) U.S. Cl.

CPC ..... *H01R 13/113* (2013.01); *H01R 2103/00* (2013.01)

(58) Field of Classification Search

CPC .. H01R 13/447; H01R 25/003; H01R 25/006; H01R 31/06

USPC ..... 439/136, 650, 651, 654, 655

See application file for complete search history.

(56) References Cited

U.S. PATENT DOCUMENTS

| | | | | |
|---|---|---|---|---|
| 4,203,646 | A | 5/1980 | Desso et al. | |
| 4,925,403 | A * | 5/1990 | Zorzy | 439/578 |
| 5,037,332 | A * | 8/1991 | Wilson | 439/607.03 |
| 6,250,960 | B1 * | 6/2001 | Youtsey | 439/578 |
| 6,350,131 | B1 * | 2/2002 | Shih | 439/65 |
| 6,398,593 | B1 * | 6/2002 | Yeh | 439/723 |
| 6,695,622 | B2 * | 2/2004 | Korsunsky et al. | 439/65 |
| 6,827,608 | B2 * | 12/2004 | Hall et al. | 439/578 |
| 7,824,191 | B1 | 11/2010 | Browder | |
| 8,083,544 | B2 * | 12/2011 | Chee | 439/578 |

(Continued)

FOREIGN PATENT DOCUMENTS

| | | |
|---|---|---|
| CN | 202167651 U | 3/2012 |
| WO | WO 2009/137347 A2 | 11/2009 |

*Primary Examiner* — Thanh Tam Le

(57) ABSTRACT

A connector system is configured for macro motion. Two mating terminals are configured so that during macro motion cycles, the resistance between two terminals does not substantially increase. One terminal can have multiple, somewhat spherical-shaped mating surfaces while a mating surface on the other terminal can be flat. The mating terminals can be configured to provide desirable resistance performance after more than 5000 cycles of macro motion.

21 Claims, 21 Drawing Sheets

(56) References Cited

U.S. PATENT DOCUMENTS

| | | | | |
|---|---|---|---|---|
| 8,096,842 | B2 | 1/2012 | Poon et al. | |
| 8,177,587 | B2 * | 5/2012 | Takagi et al. | 439/733.1 |
| 8,317,539 | B2 * | 11/2012 | Stein | 439/578 |
| 8,573,983 | B2 * | 11/2013 | Zieder | 439/8 |
| 8,597,050 | B2 * | 12/2013 | Flaherty et al. | 439/578 |
| 2008/0110488 | A1 | 5/2008 | Buller et al. | |
| 2009/0114438 | A1 * | 5/2009 | van Haaster | H05K 9/0015 174/356 |
| 2010/0199493 | A1 | 8/2010 | Chansrivong | |
| 2011/0138599 | A1 | 6/2011 | Bellacicco et al. | |

* cited by examiner

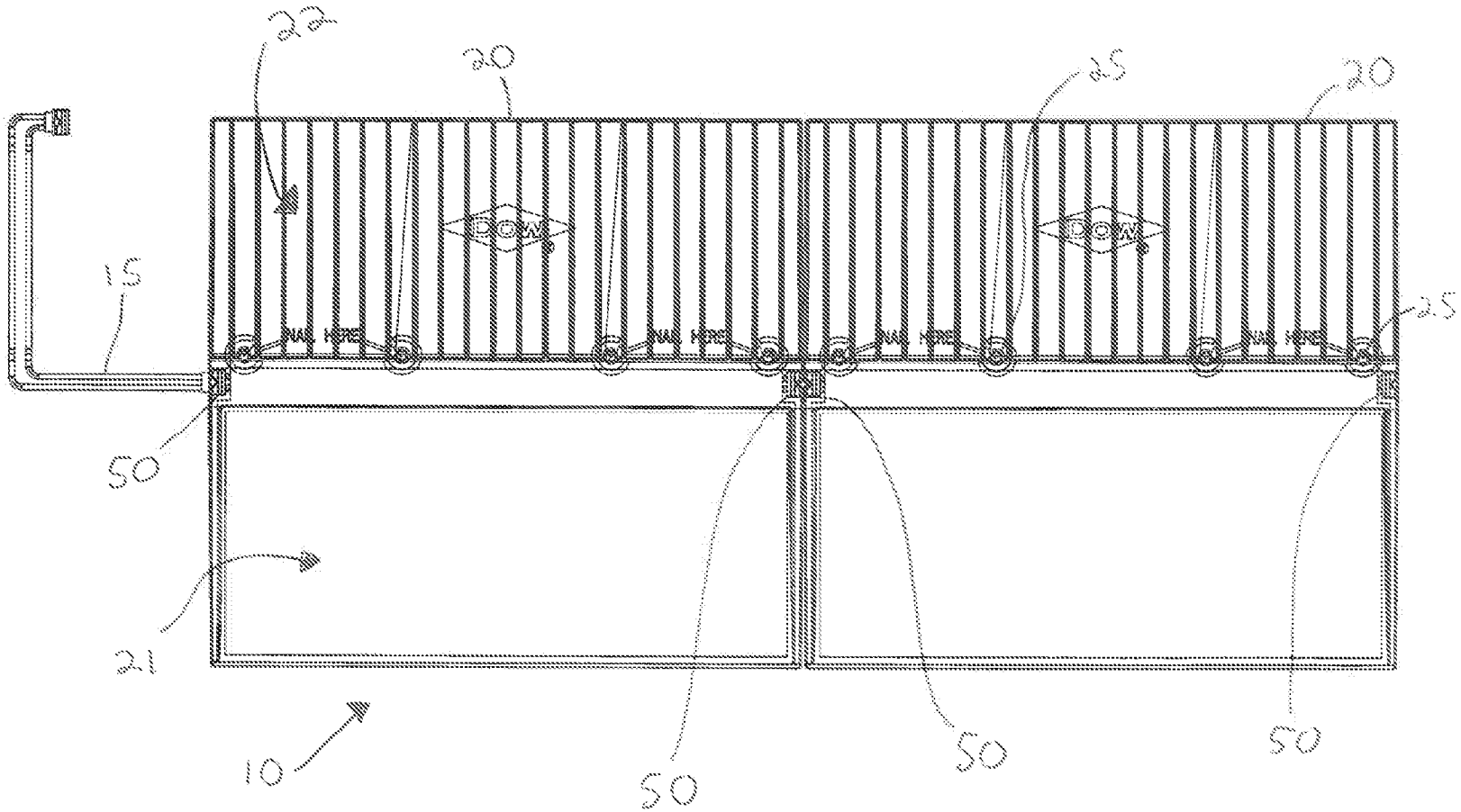
30
35
35
35

SYSTEM AND CONNECTOR CONFIGURED FOR MACRO MOTION

RELATED APPLICATIONS

This application claims priority to U.S. Provisional Application Ser. No. 61/541,256, filed Sep. 30, 2011, which is incorporated herein by reference in its entirety. This application was filed concurrently with the following application, which is not admitted as prior art to this application and which is incorporated herein by reference in its entirety:

PCT Application No. PCT/US 12/7422, entitled System and Connector Configured for Macro Motion.

FIELD OF THE INVENTION

The present invention relates to the field of electrically connecting two devices that have relative motion.

DESCRIPTION OF RELATED ART

Solar power is one of a number of technologies that can be utilized to help reduce the current dependence on fossil fuels for meeting energy needs. The radiant energy from the sun delivered to the earth's surface each day far exceeds the world-wide demand for energy and therefore an efficient means of collecting solar energy would fundamentally change the energy landscape Renewable power has the potential to substantially reduce fossil fuel consumption and resulting emissions that are likely to face tighter regulatory scrutiny in the future.

Solar power, however, faces certain challenges. One issue is that geographical regions that have greatest levels of sunlight (e.g. between 30° north and 30° south latitude) may not necessarily be close to the locations where power consumption is highest. Since these areas also tend to have less cloud cover, mirror-based solar-thermal systems and concentrating photovoltaic systems are ideally suited for these locations, assuming they include suitable aiming systems to properly take advantage of the earth's rotation.

For many urban locations with a higher population density, (for example, the east cost of the United States of America and in many regions in Asia) a system that works well with indirect light (such as systems that use non-concentrating photovoltaic panels) is often more effective in generating power. Due to the ability to place the systems closer to end usage applications, these systems also offer the advantage of less energy loss in transferring power between the point of power generation and the point of energy consumption.

The most efficient method of reducing power transmission costs is to place the energy producing device directly at the location where the energy is being consumed. For example, placing solar panels on the roof of a home tends to be an effective method of providing electrical power to that home as it takes advantage of an otherwise unused surface area while minimizing loss caused by the transit of electricity. One major issue, however, is that solar systems are somewhat expensive to install. Thus it is desirable that the installed system be cost effective. In addition, current photovoltaic systems tend to be less attractive as they tend to create less attractive sight lines on homes, particularly on homes where the south side of the home faces the street. Therefore, further improvements to photovoltaic systems are desirable to help such system appeal to a broader range of end users.

BRIEF SUMMARY

A connector system is configured for macro motion. Two mating terminals are configured so that during macro motion cycles, the resistance between two terminals does not substantially increase. In an embodiment, an energy system comprises a first panel supporting a first header with a first terminal and a second panel supporting a second header with a second terminal. The first and second panel are configured to be mounted adjacent each other and a connector with a first and second end that couples the two panels. The connector includes a third terminal configured to electrically couple the first and second terminal, wherein the first, second and third terminal are configured to provide a resistance between the first and second terminal that increases less than 20 milliohms after 5000 cycles of macro motion between the first and second panel.

BRIEF DESCRIPTION OF THE DRAWINGS

The disclosure provided below is illustrated by way of example and not limited in the accompanying figures in which like reference numerals indicate similar elements and in which:

FIG. 1 illustrates a plan view of an exemplary energy transfer system.

FIG. 8 illustrates a perspective view of an embodiment of a header mated to a connector.

FIG. 9A illustrates a perspective view of a section of FIG. 9 taken along line 9A-9A.

FIG. 12 illustrates a plan view of the embodiment depicted in FIG. 11.

DETAILED DESCRIPTION

Figure 2D:
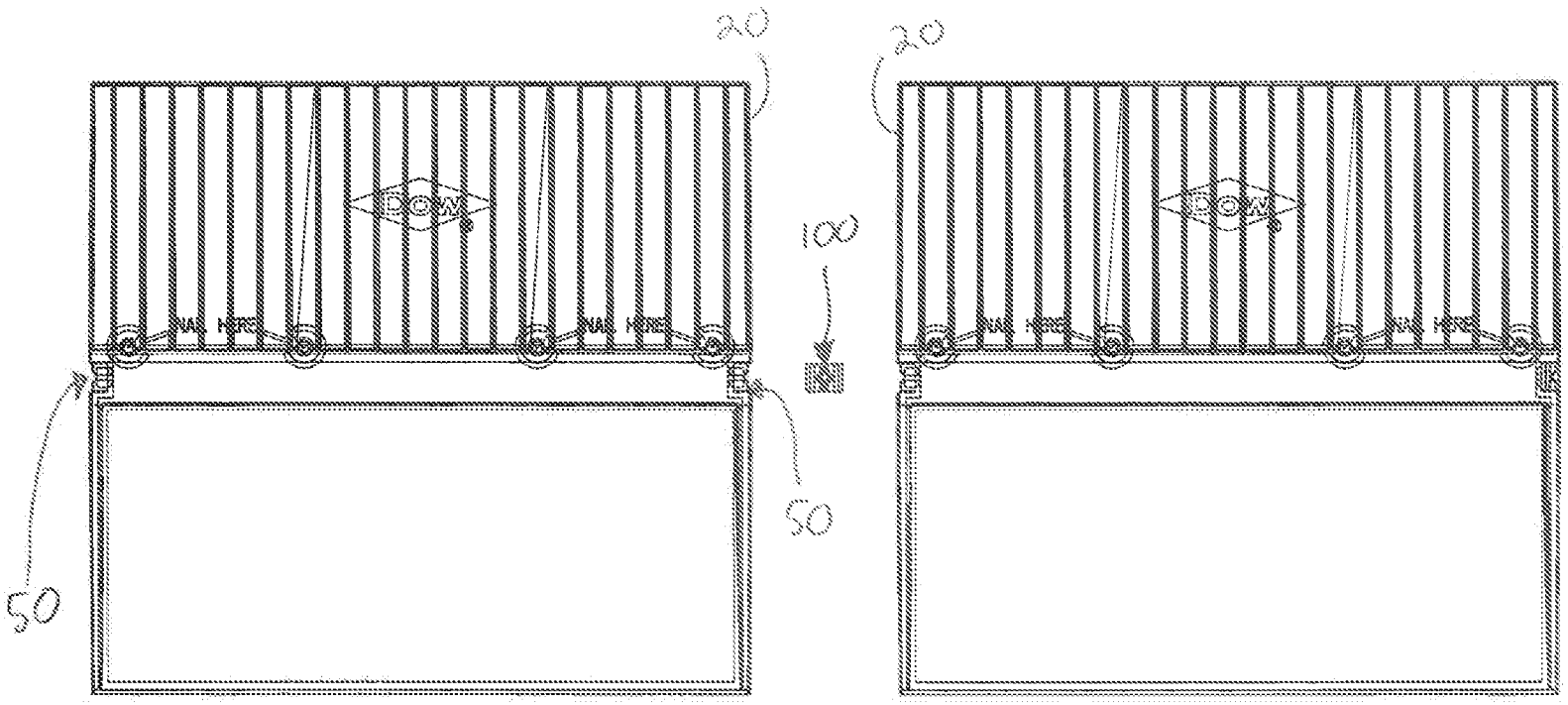
FIG. 2 illustrates a partially exploded view of the system depicted in FIG. 1.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Before addressing certain details below, it should be noted that many conventional systems for providing energy transfer exist. In general, when an energy transfer system is used in an environment that provides for large temperature swings, the natural translation caused by the coefficient of thermal expansion of the system must be accounted for in order to have a reliable system. The translation caused by the expansion has, in the past, been handled by using a flexible component. For example, a bent wire can be used to couple two contacts on two separate/separable modules that are intended to be electrically coupled together. As the two modules contract and expand due to thermal cycling, the bent wire flexes with the relative translation and allows the electrical connector to be maintained in a reliable manner. Such a system is frequently used on solar panels, for example. It is known, for example, to have solar panels that are supported by a frame and electrically coupled together via flexible elements.

It has been determined that such a system, while effective for some applications, is unable to provide certain benefits. For example, the flexible wires need to be positioned in such a manner that they can flex and potentially may be directly exposed to the environment. Furthermore, flexible wires require a certain level of space to connect as their flexibility makes installation more challenging. This can make it challenging to provide a low profile design. Furthermore, for panels that are mounted on a roof, the need to ensure the panels are securely mounted on an otherwise water resistant/waterproof surface further complicates installation matters.

One way to address this issue is to provide shingles that mount directly on the roof and also provide photovoltaic energy generation. For example, a solar shingle could be secured to the roof with nails. FIG. 1 illustrates an exemplary embodiment of such a design. As can be appreciated, an exemplary energy transfer system 10 includes panels 20 that have a solar conversion region 21 and a covered region 22. In practice, when several rows of panels are mounted, the solar conversion region 21 will occlude the covered region 22 in a manner similar to a conventional roofing shingle, thus providing water resistance and power generation at the same time. Fastener points 25, which are shown as being provided in a predetermined location, are provided to secure the panel 20 to a substrate (such as a base of the roof). Receptacles 50 are provided on both sides of the panel 20 and are used to electrically couple two adjacent panels 20 together.

As depicted, a wire 15 plugs into one receptacle 50 and can couple a first row of panels to a second row of panels or an external system (not shown) that is designed to store or handle generated power. To couple two adjacent panels, a biscuit 100 is provided. The depicted biscuit 100 can be inserted into one receptacle 50 and is rigid enough to allow a second panel with a corresponding receptacle 50 to be translated into an install position without the need to separately support the biscuit 100. Thus, in an exemplary embodiment, the panel is secured to an underlying substrate, a biscuit is inserted into the receptacle, and then a second panel with a receptacle is aligned and translated into an installed position that causes the biscuit to be inserted into the receptacle of the second panel. Naturally, the first panel can be partially nailed into position (for example, just the right two nails could be installed) so that the first panel is still slightly flexible so as to aid installation of the adjacent panel. Alternatively, multiple panels can be joined together with biscuits and then attached to a roof.

Figure 3:
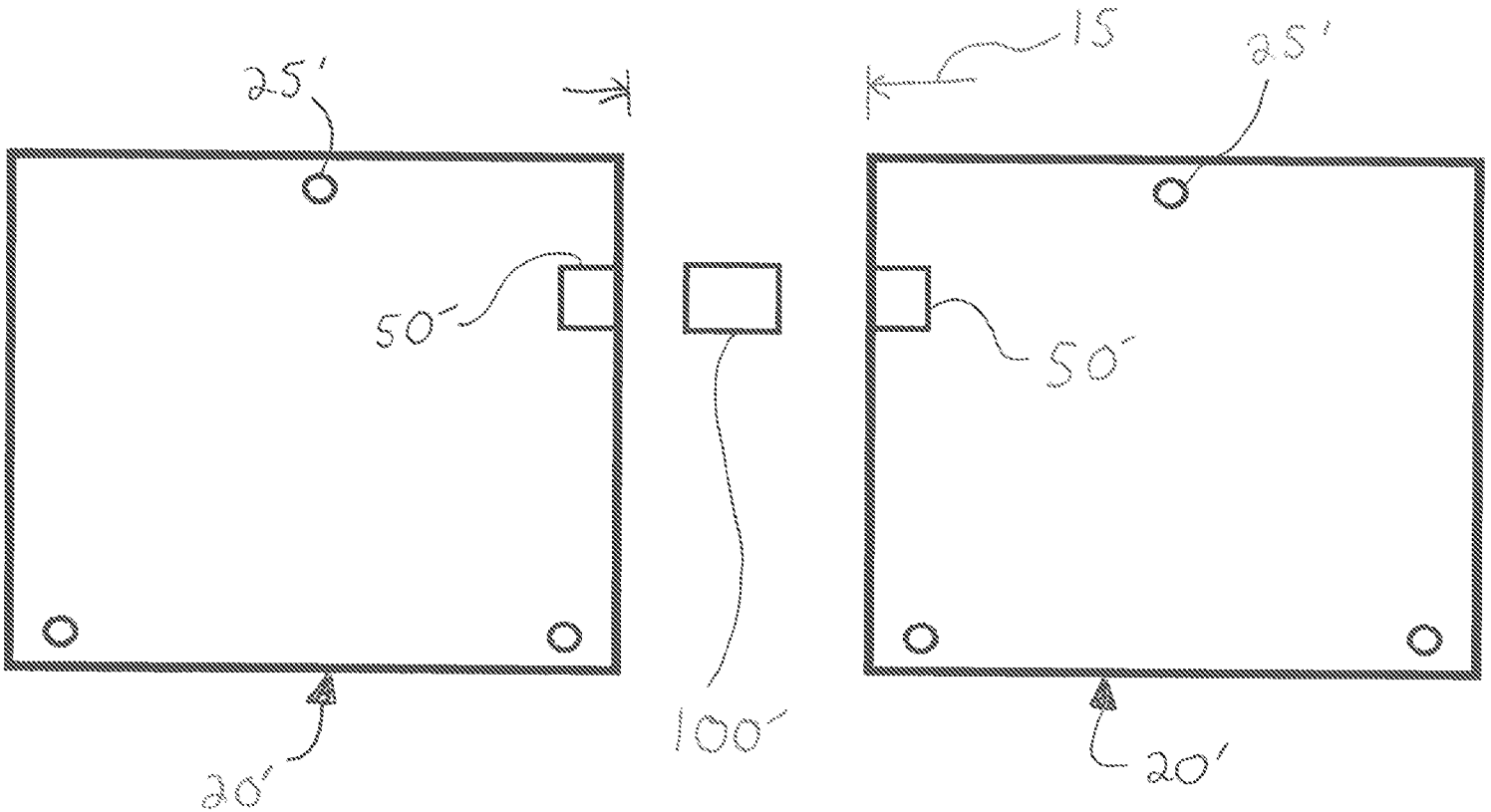
FIG. 3 illustrates a schematic of an exemplary energy transfer system.

FIG. 3 illustrates a schematic representation of a module 20', which could be a panel or any other desirable shaped module, with three attachment points 25' (which could be fastener points). It should be noted that while the attachment points 25' are shown located in different locations, in an embodiment where the module was intended to provide a panel that acted as a replacement for a conventional roofing shingle, the attachment points would likely be positioned as shown in FIG. 1 and the module 20' would be panel shaped (e.g., relatively flat and rectangular in shape). However, for other applications the module 20' might have a different shape (such as square) and could be of varying thicknesses. For example, but without limitation, if a module 20' was intended to provide illumination and included (for example, but without limitation) LEDs then attachments points 25' might be provided at the four corners. As can be appreciated, each panel includes a header 50', which in the embodiment depicted in FIG. 1 is a receptacle with a male terminal. Alternatively the header could be plug shaped. In addition, the terminal could be in either a male or female configuration, it being understood that the connector 100' would be configured to mate with the corresponding header 50'. Naturally, the header 50' need not be configured the same for each module 20', so long as the connector 100' (which in the embodiment depicted in FIGS. 1 and 2 is a biscuit 100) was configured accordingly.

Regardless of the module 20' configuration, one situation that can be expected is that when mounted to a substrate, the first and second module 20' will be secured so that they are a distance 15 apart (which is exaggerated in FIG. 3 for purposes of illustration) and connector 100' will electrically couple the two modules 20' together. As can be expected, due to coefficient of thermal expansion, when the temperature of the modules 20' change the distance 15 can also change. For typical outdoor environments, the temperature of the panels might increase over a period of several hours, then remain elevated for a number of hours, and then slowly cool. This tends to cause the distance 15 to slowly change from a first value to a second value over a period of time (usually at a rate that is too slow to visually perceive in real time and is expected to be less than 1 mm per minute), remain at the second value for an extended period of time, and then gradually return to the first value. This motion is referred to as macro motion and for a panel mounted on a roof, it is expected that on most days at least one cycle of macro motion will take place (sometimes more than one cycle of macro motion will take place in one day if the weather is suitable and there is precipitation and/or changes in cloud cover but if there was a steady rain, perhaps no macro motion cycle would occur). As compared to typical vibration motion that would be expected to be less than 0.01 mm of motion (and more typically less than 0.001 mm) and occur rapidly (at a rate of greater than 0.25 per second), macro motion usually has a translation that is at least an order of magnitude greater and generally will be at least 0.25 mm and will occur too slowly to be readily perceived by a human observer (typically less than 1 mm per minute and more typically less than 1 mm per 15 minutes). Indeed, for panels mounted on a roof, it is expected that macro motion in the range of 0.5-2.0 mm will be common and the displacement in one direction due to heating of the panels will take place over a period of an hour or more.

While the slow movement of macro motion potentially provides a different wear pattern in the electrical contacts, one of the interesting issues with macro motion is the time between translations. Normal vibration is rapid, (e.g., having a frequency of greater than 1 Hz) and does not leave an exposed area that was in physical proximity but currently is not in physical proximity with the opposing contact surface for substantial periods of time. In contrast, macro motion can cause mating elements to translate (causing some wipe and wear) across an area and then leave that area exposed for a substantial period of time (potentially for multiple hours at a time). For example, a contact area with a contact width along a wear path might translate a distance along the wear path of more than twice the contact width and in certain embodiments might translate more than 5 times the width. The exposed area, while originally coated with a plating that inhibits oxidation and/or other forms of corrosion, can after some number of cycles have some portion of the coating worn away. The exposed area thus becomes susceptible to the possibility of corrosion forming on the surface. This possibility is increased when the temperature is elevated (for example, in the 60 C or greater range that can readily occur on a surface of a roof) and the environment is humid. Thus, the convention design of providing a plating of a noble metal, such as gold, palladium, silver, etc. . . . , (that is resistant to corrosion) so as to minimize the effects of corrosion is complicated by the potential for some of the plating to be displaced out of a wear path formed by the relative translation of opposing contacts. It should be noted that when a noble metal is used, it is expected to have at least trace amounts of other elements but generally is more than 90% pure and more commonly is more than 95% pure, however the make-up of the plating is not intended limiting unless otherwise noted.

It should be noted that when two panels are electrically connected together with a connector, while both panels may translate with respect to each other, in certain configurations just one of the panels might translate with respect to the connector. Thus, macro motion might only be experienced on one side of the connector. However, it is also possible that macro motion will occur on both sides of the connector.

Figure 4:
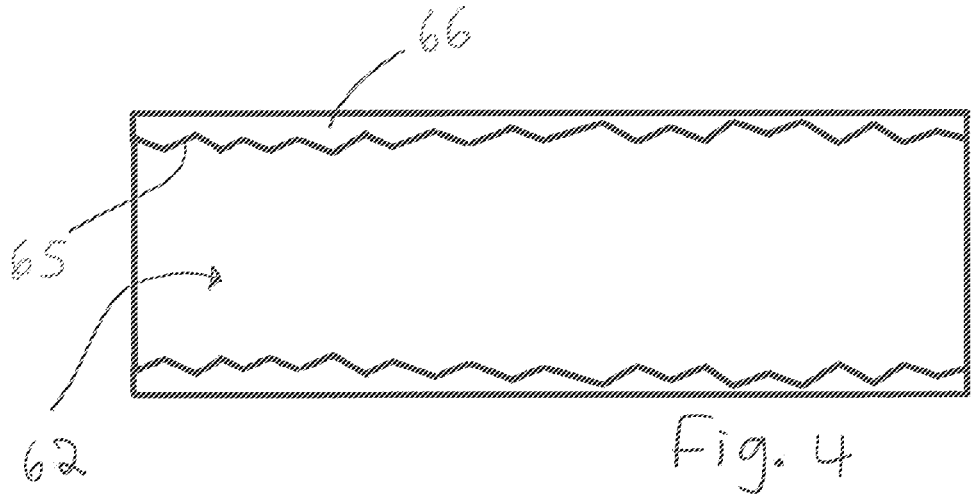
FIG. 4 illustrates a schematic view of an exemplary contact surface.
Figure 5:
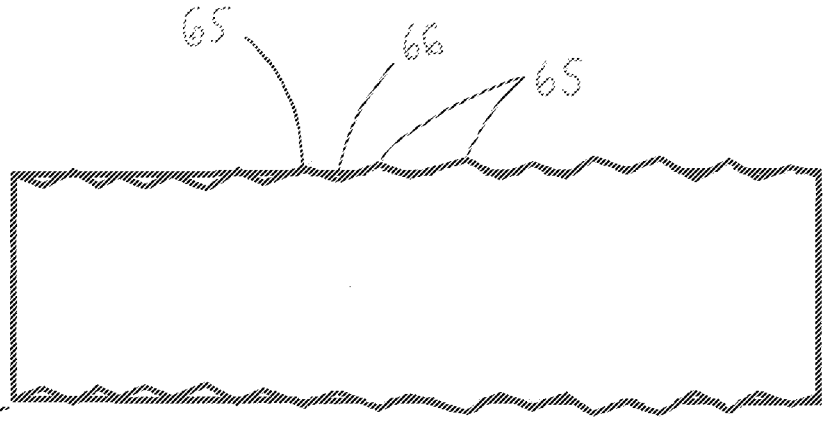
FIG. 5 illustrates the contact surface of FIG. 4 after being subject to wear.
Figure 6:
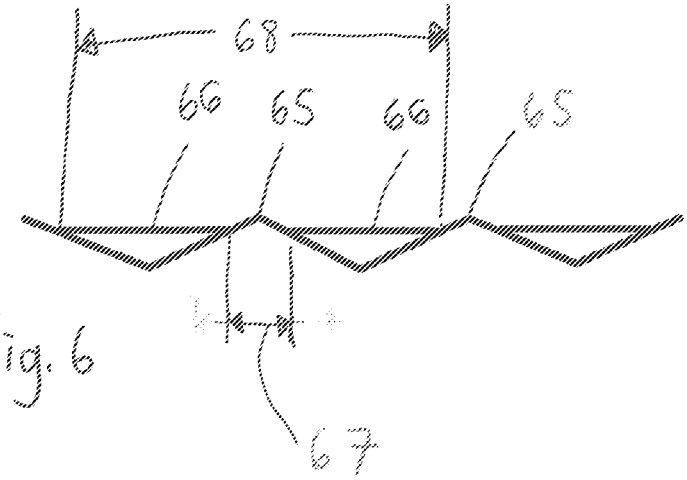
FIG. 6 illustrates an enlarged view of a portion of the contact surface of FIG. 5.

Applicants have determined that in an embodiment the issue of surviving macro motion can be addressed with a combination of factors. For example, as schematically depicted in FIG. 4, a contact 62 includes an undercoat surface 65 (which can be, without limitation, a nickel-based surface that can be provided over a copper-alloy base material) and a plating 66 (which can be a noble metal or other plating that resists corrosion) that covers the undercoat surface 65. The undercoat surface 65 can be rough and include peaks and valleys (e.g., can have depressions) that initially are covered by the plating 66. Over time, however, the plating 66 can be displaced due to the wear caused by opposing elements (e.g., a contact and a finger). In such an event, the plating 66 can still reside in the depressions while much of the plating is displaced from the peaks of the undercoat surface 65 so that they are exposed. In an embodiment, over a distance 68 (which can be about 5 millimeters) a change between a surface covered by the plating and a surface of exposed undercoat will occur and a width 67 of the change can be 0.5 millimeters. The retention of the plating in the depression helps ensure that some level of the plating will remain in the wear path and can help maintain a good electrical connection.

It has been further determined that with a suitable lubrication, the combination of the lubrication and the alternating surfaces has been determined to provide acceptable resistance to increases in resistance. While it generally would be desirable to have a system that can survive at least 5000 cycles of macro motion (which could be equivalent to about 7-10 years of life) with minimal resistance increase, it is more desirable to have a system that can provide at least 7000 and even more preferably can provide 15,000 or 20,000 cycle of macro motion with a minimal increase in resistance.

It should be noted that minimal resistance increase is deemed to be less than a 20 milliohm increase between two terminal coupled together by a third terminal provided. Thus, a system would be considered to have successfully passed some number of macro motion cycles as long as the resistance between two terminals in headers of adjacent modules did not increase more than 20 milliohms. For systems that are intended to provide greater levels of efficiency over time, the acceptable resistance increase may be reduced to less than 10 milliohms. For example, a system might have a starting resistance of about 7 milliohms and the resistance after the desired number of cycles of macro motion would be less than 17 milliohms. As can be appreciated, the actual starting values of resistance will depend on materials selected and the design of the contacts and terminals. It should also be noted that below a certain point, the benefits of further reducing the resistance tends to be balanced out by the up-front costs of providing a contact system that provides further performance enhancements. Furthermore, it is not expected that a starting resistance of 0 milliohms is possible (or necessary) in any system that is based on a connection between two mating contacts. Thus, as can be appreciated by a person of skill in the art, meeting a condition such as a starting resistance of less than 10 milliohms would normally be done in a reasonable and cost-effective manner that ensures the terminals over a range of desired standard deviations will meet the requirements rather than attempting to reach as close to 0 milliohms as possible.

As can be appreciated, depending on the expected temperature of the operating environment, the selecting of a more capable lubrication may be beneficial. Potential examples of lubricants include 716L or 8511 in Dispersion from NYE. Applicants note that in general the use of a perfluoropolyether based lubricant is likely to be considered helpful due to material properties of such lubricants (such as their tendency to have good resistance to degradation at higher temperatures). However, depending on the application any desirable lubricant could also be used. The desirability of a particular lubrication will depend on the desired number of macro motion cycles, the cost and the expected application, which will include consideration of factors such as, without limitation, expected moisture levels, temperature, contact geometry, desired dynamic viscosity, desired product life and forces being applied. For example, a lubricant that is resistant to being degraded by temperatures in the 90 C range would be helpful for applications that regularly see summer temperatures in the 75-85 C. However, a less expensive lubricant might be suitable for applications that did not typically exceed 50 C. Consequentially, the selection of the lubrication and plating materials will vary depending on the intended application and other cost considerations and numerous other factors regularly considered by those of skill in the art and as such, the selection of a suitable lubrication is within the knowledge of one of skill in the art and need not be discussed further herein.

Figure 7:
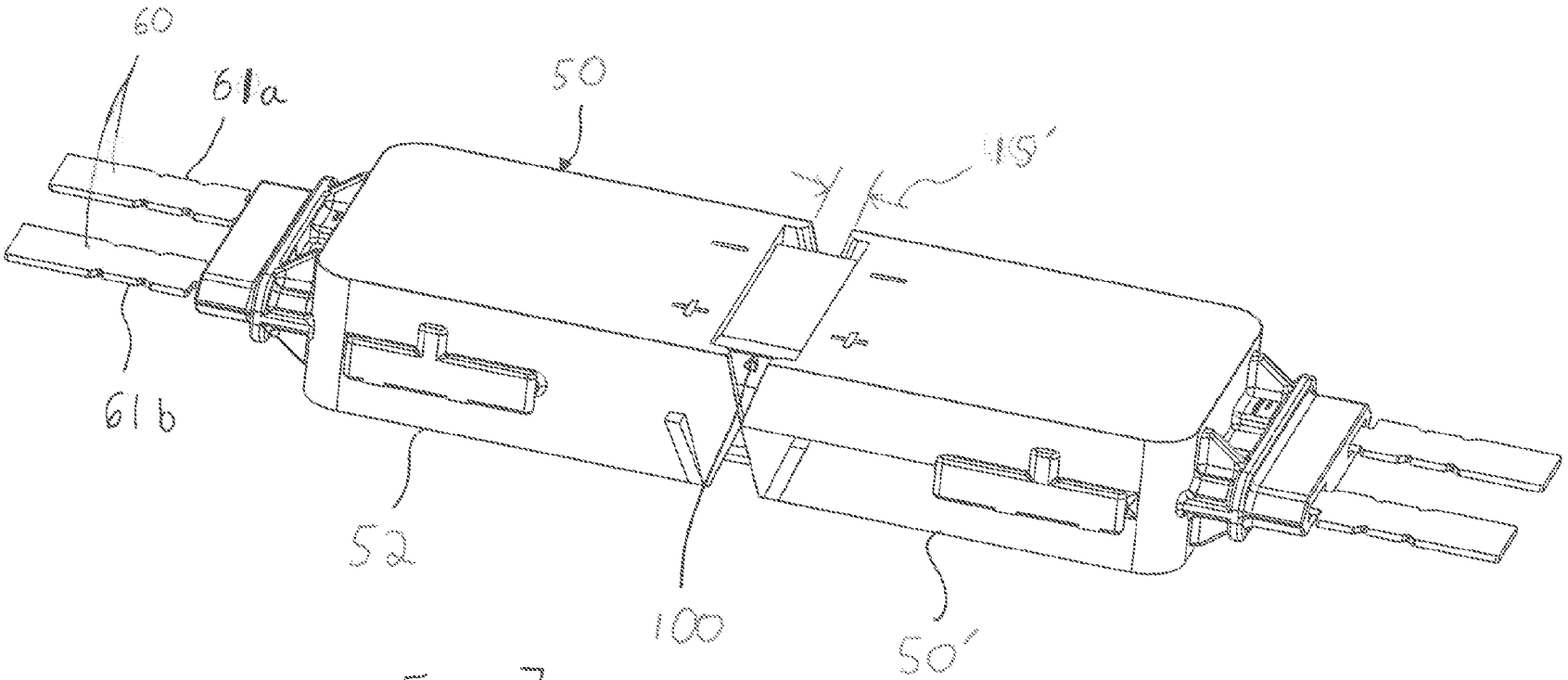
FIG. 7 illustrates a perspective view of an embodiment of two headers engaging a connector.
Figure 6:
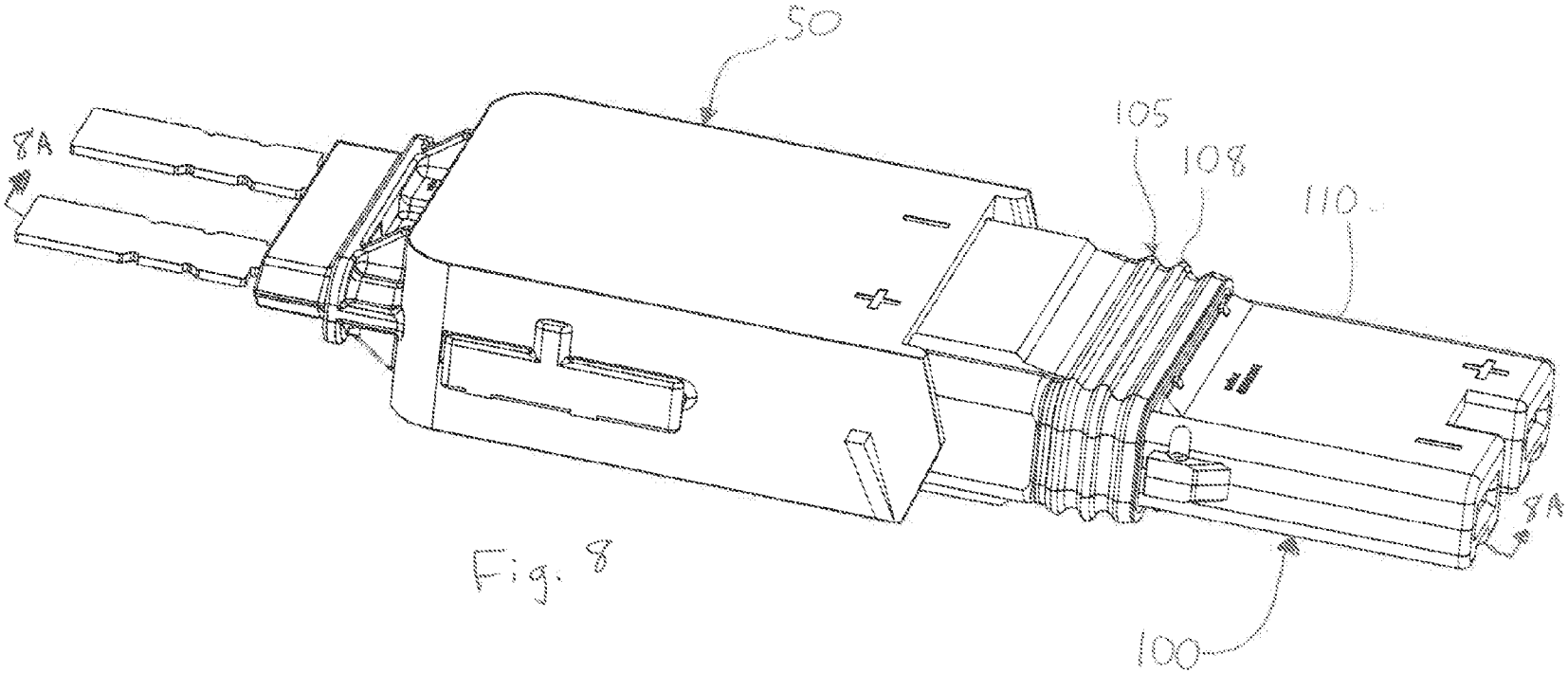
Figure 8A:
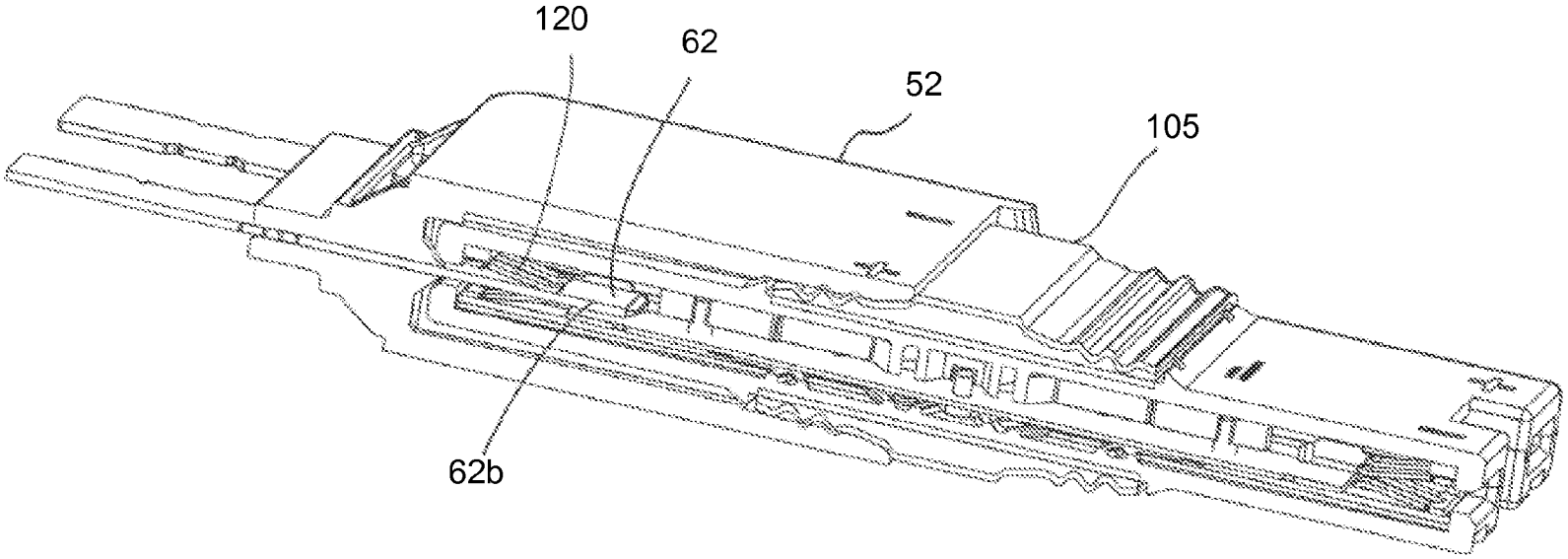
FIG. 8A illustrates a perspective view of a section of FIG. 8 taken along line 8A-8A.
Figure 9:
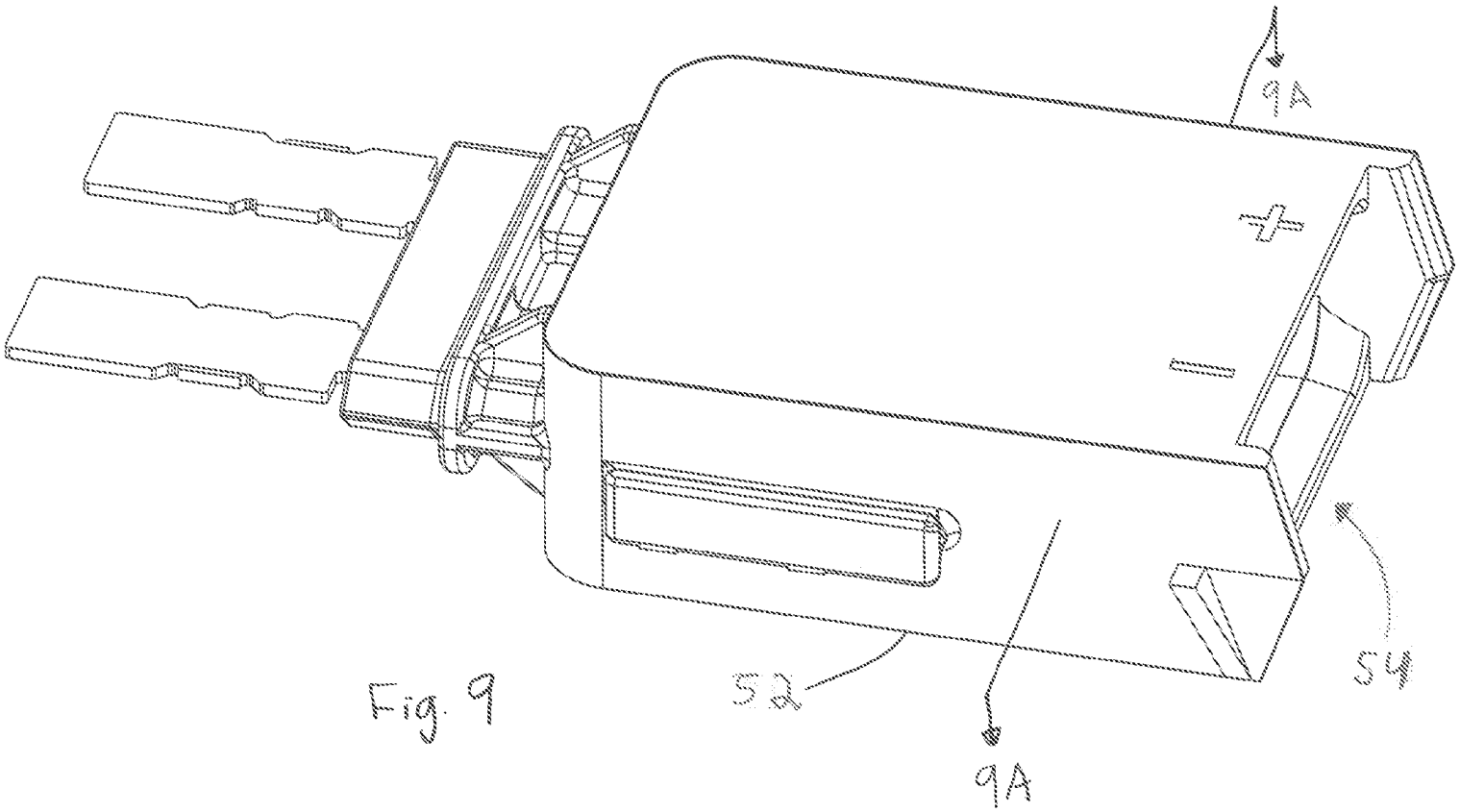
FIG. 9 illustrates a perspective view of an embodiment of a header.
Figure 14:
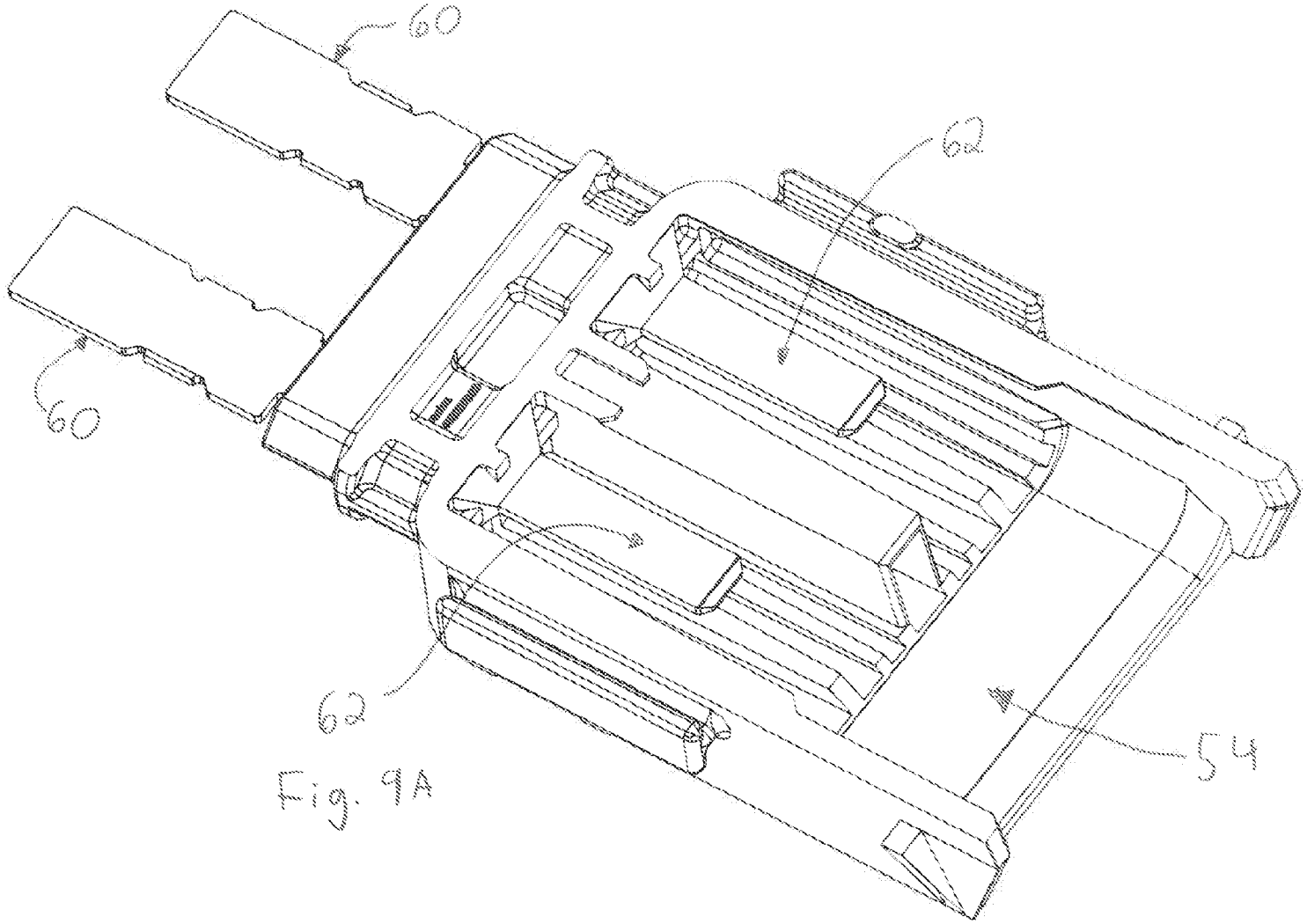
FIG. 14 illustrates a perspective view of an embodiment of terminal that can be positioned in a biscuit.
Figure 10:
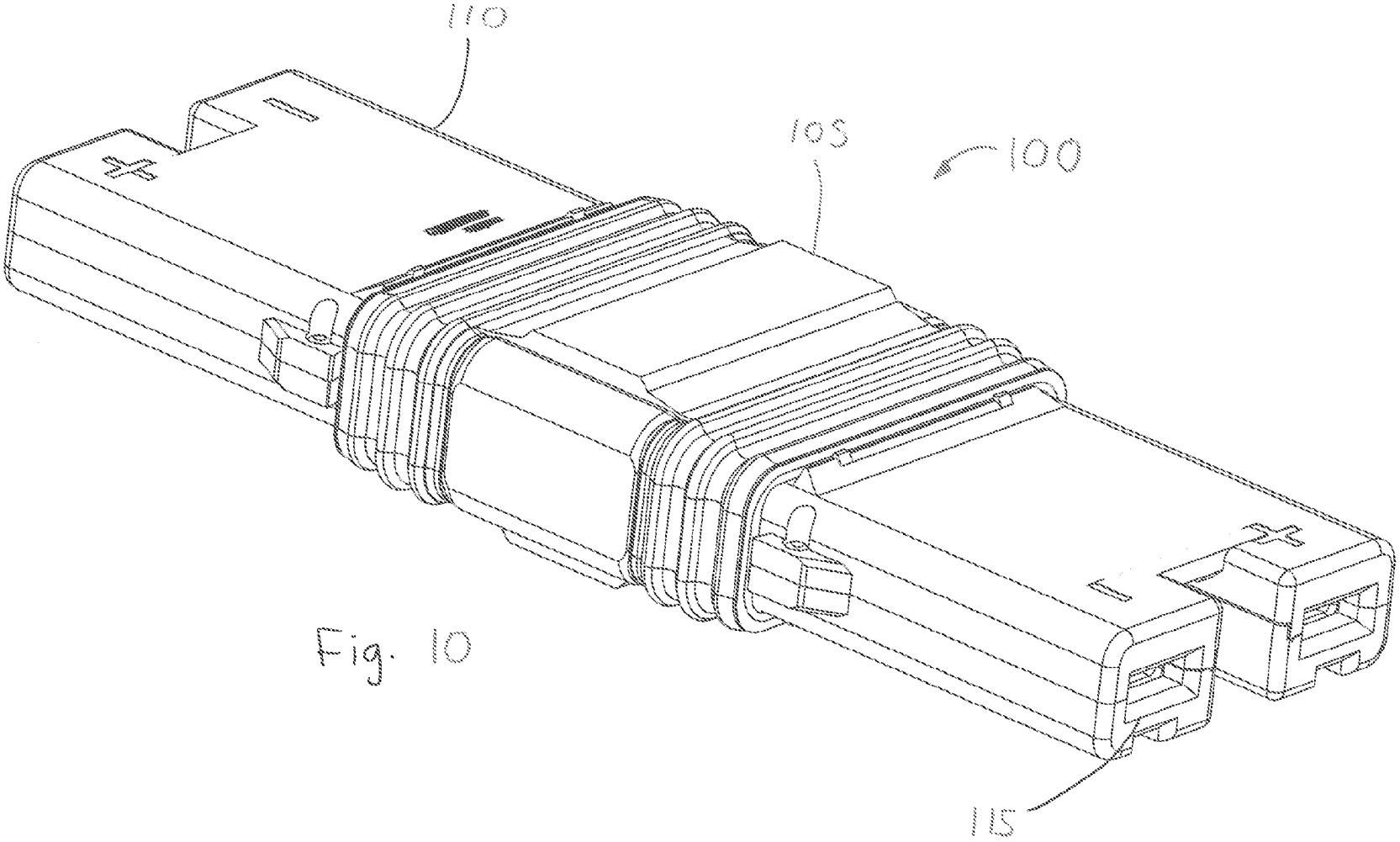
FIG. 10 illustrates a perspective view of an embodiment of a biscuit that can operate as a connector.
Figure 11:
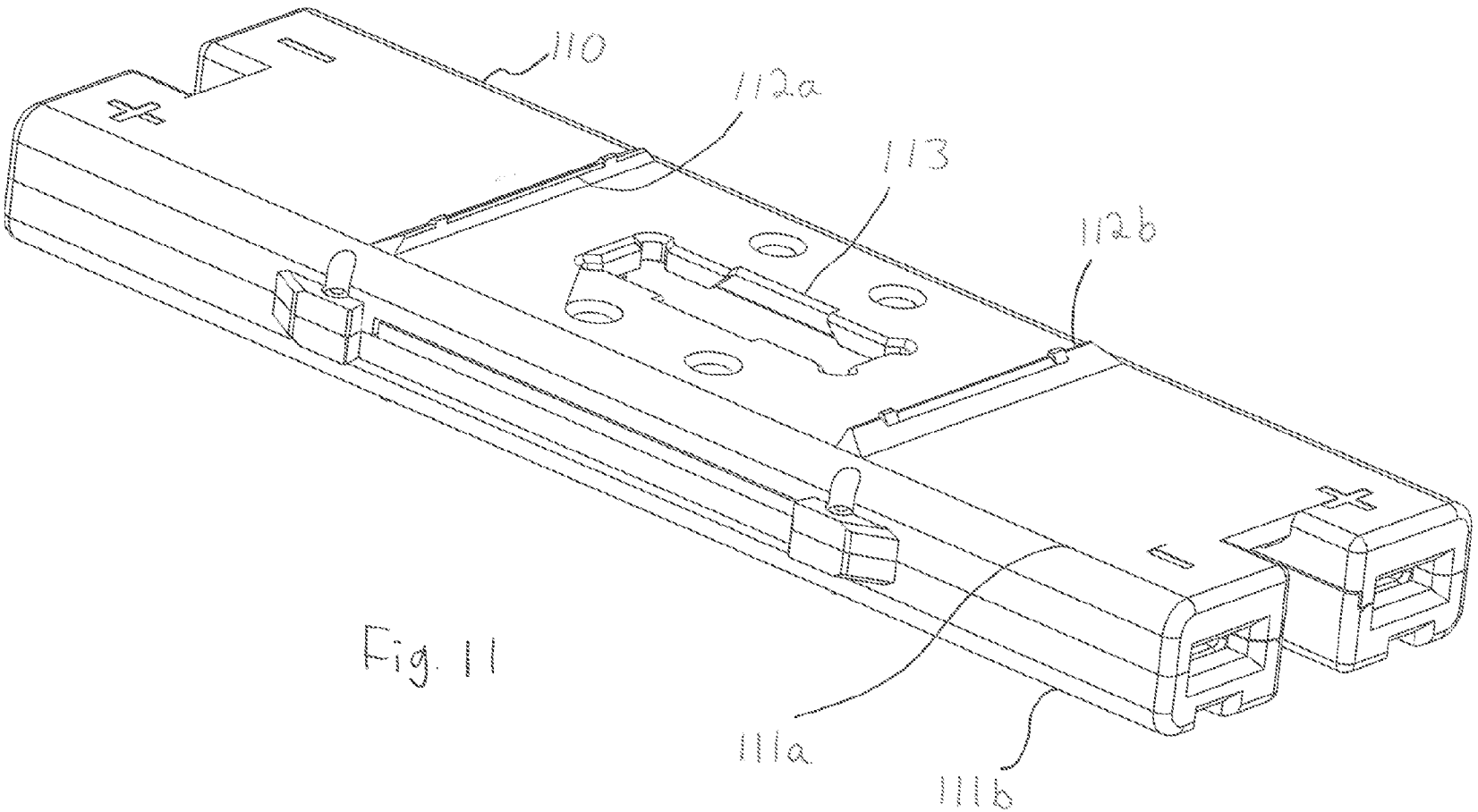
FIG. 11 illustrates a perspective view of a simplified version of the biscuit of FIG. 10.
Figure 10:
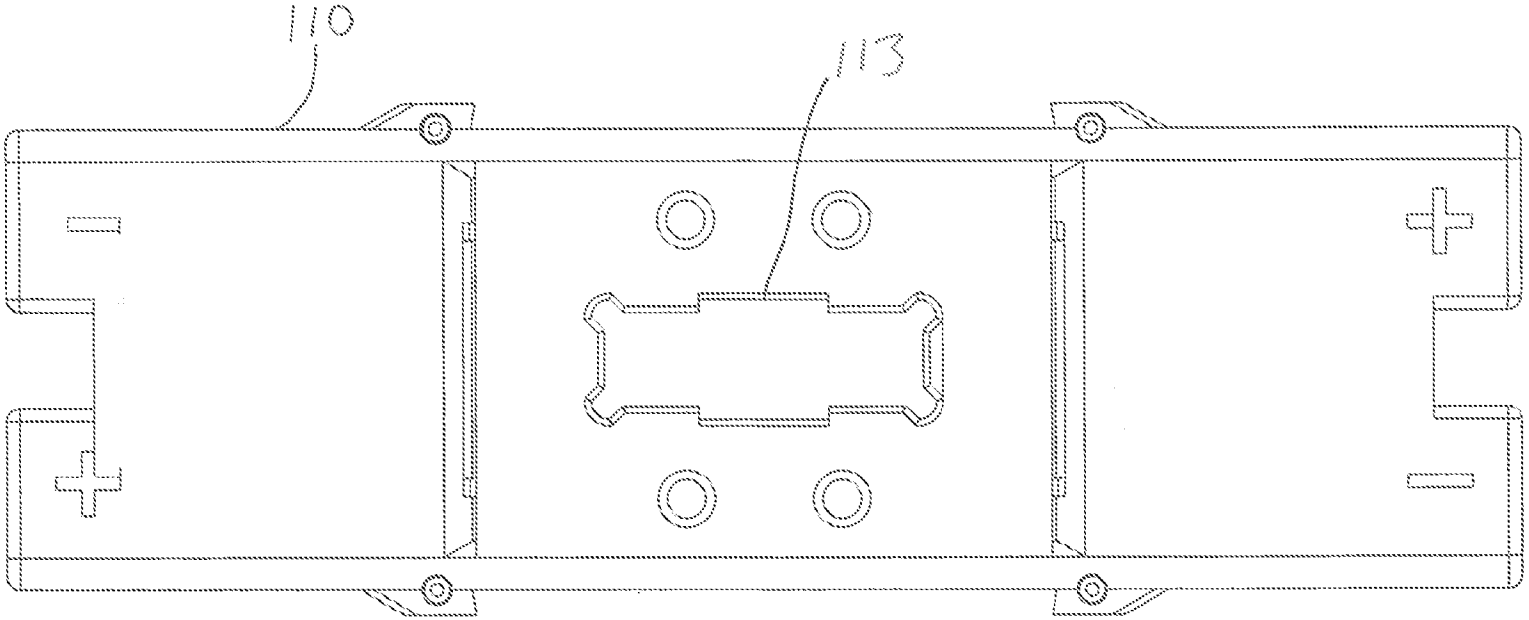

FIG. 7 illustrates two receptacles 50, 50', which are examples of a header, electrically coupled together by a connector, which as depicted is a biscuit 100. It should be noted that in certain embodiments where there was no desire to have the supporting panels positioned relatively close to each other, the housing configuration of the biscuit 100 and the receptacle 50 could be reversed and the header could be configured with a projection (instead of a recess) that was intended to be inserted into a recess in the connector. Thus the depicted structure, while beneficial for panels used as roofing shingles, is not intended to be limiting unless otherwise noted.

As depicted, the receptacle includes a frame 52 and two terminals 60 supported by the frame 52 that provides first ends 61*a* and 61*b*. In practice, it is expected that the first ends 61*a*, 61*b* will be disposed internally in a panel and crimped or soldered to conductive elements (which may be flexible if desired) that are in turn coupled to energy conversion elements. In that regard, as can be appreciated, an energy conversion element can generate electricity from light or could use electricity to generate something (such as light or any other desirable output) and thus the energy conversion portion is not intended to be limiting. It should be noted that as depicted, the distance 15 separating the two receptacles 50, 50' is at a minimum. In practice, the distance 15 will normally be greater than the minimum and it is expected that for most applications two adjacent receptacles will not be configured so that the spacing between them reaches a minimum.

The depicted biscuit 100 includes a housing 110 and a gasket 105, which may be a silicon based material or other desirable material, with ridges 108. The ridges 108 of the gasket 105 are configured to seal against a pocket 54 provided in the frame 52 so as to provide a substantially water-tight seal therebetween. This allows the terminal 120 to engage the contact 62 on a second end 62*b* of terminal 60. The depicted design is shown with two terminals that each have the contact 62, however some other number of terminals and contacts could be provided.

Figure 13:
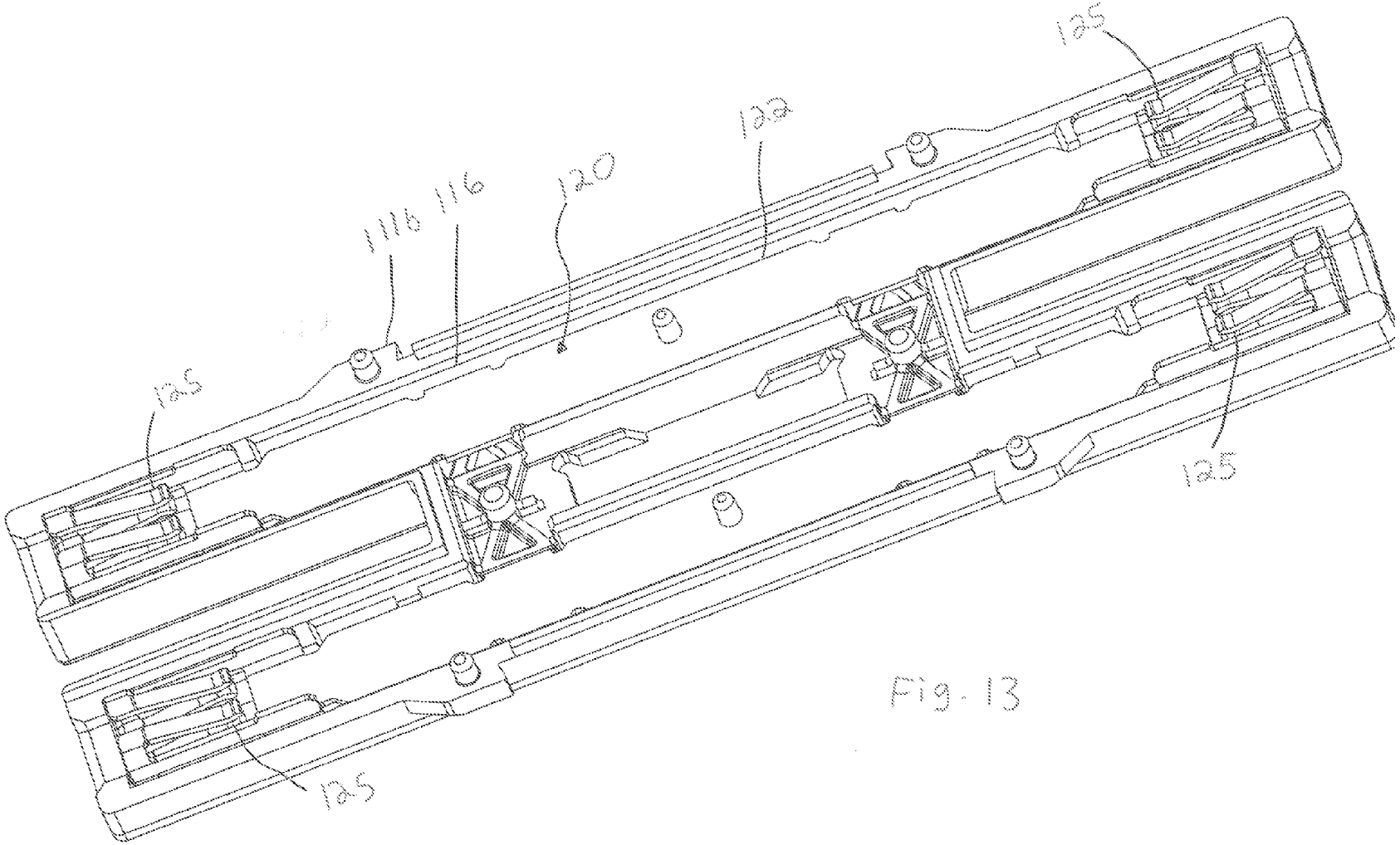
FIG. 13 illustrates a perspective view of an embodiment of a biscuit with one half of a housing removed.
Figure 14:
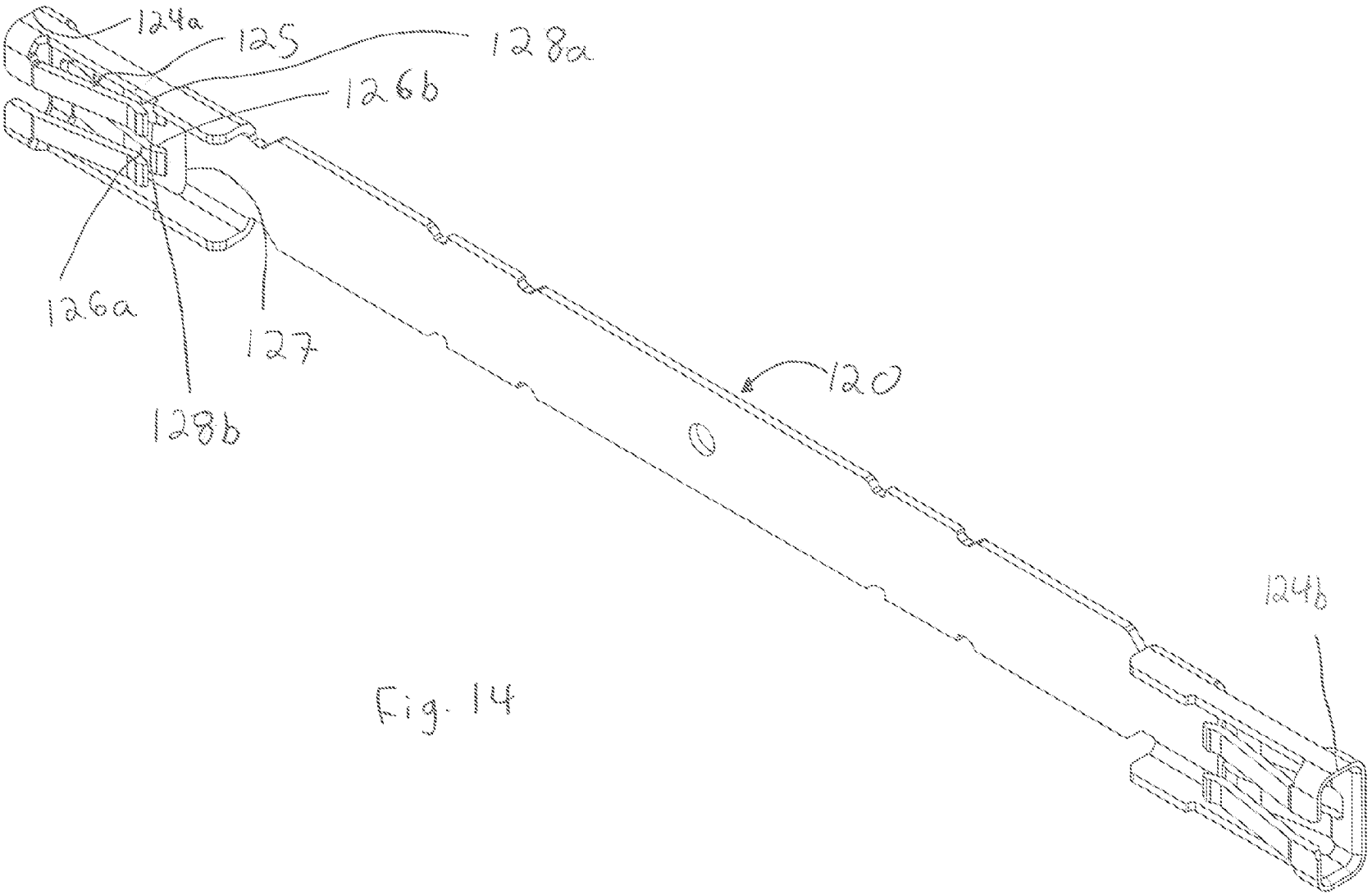
Figure 15:
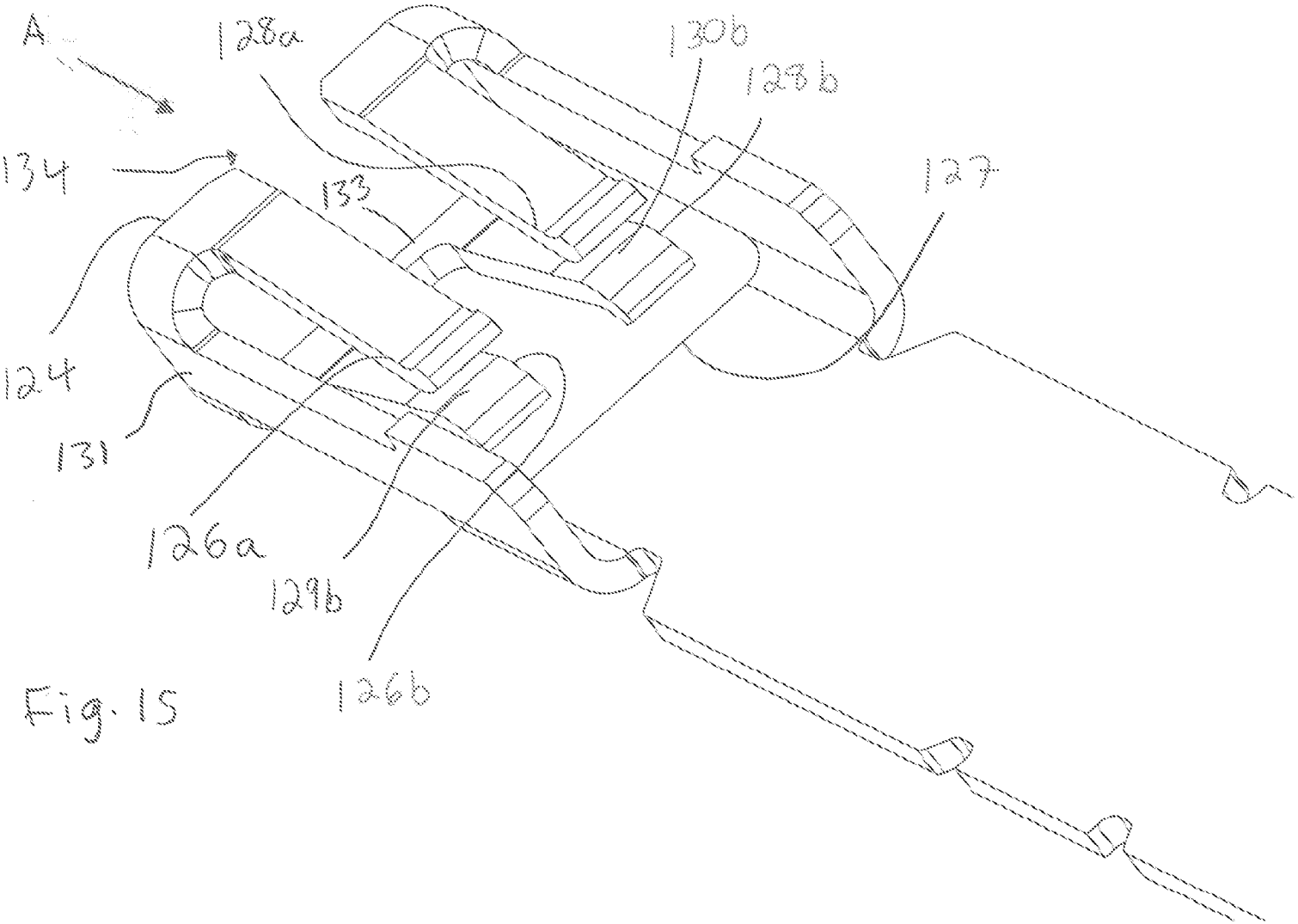
FIG. 15 illustrates a perspective view of an end of a terminal that includes multiple contacts.
Figure 16:
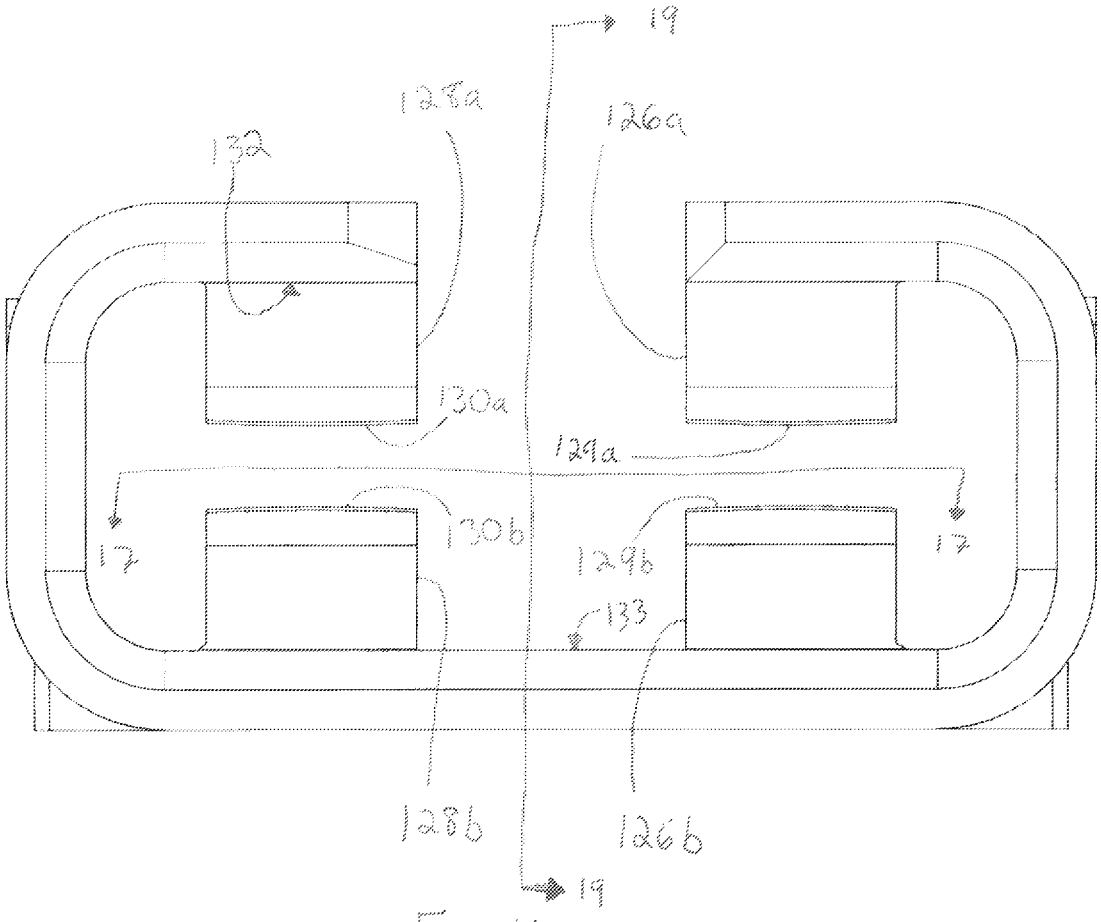
FIG. 16 illustrates an elevated front view of the portion of the terminal depicted in FIG. 15.
Figure 17:
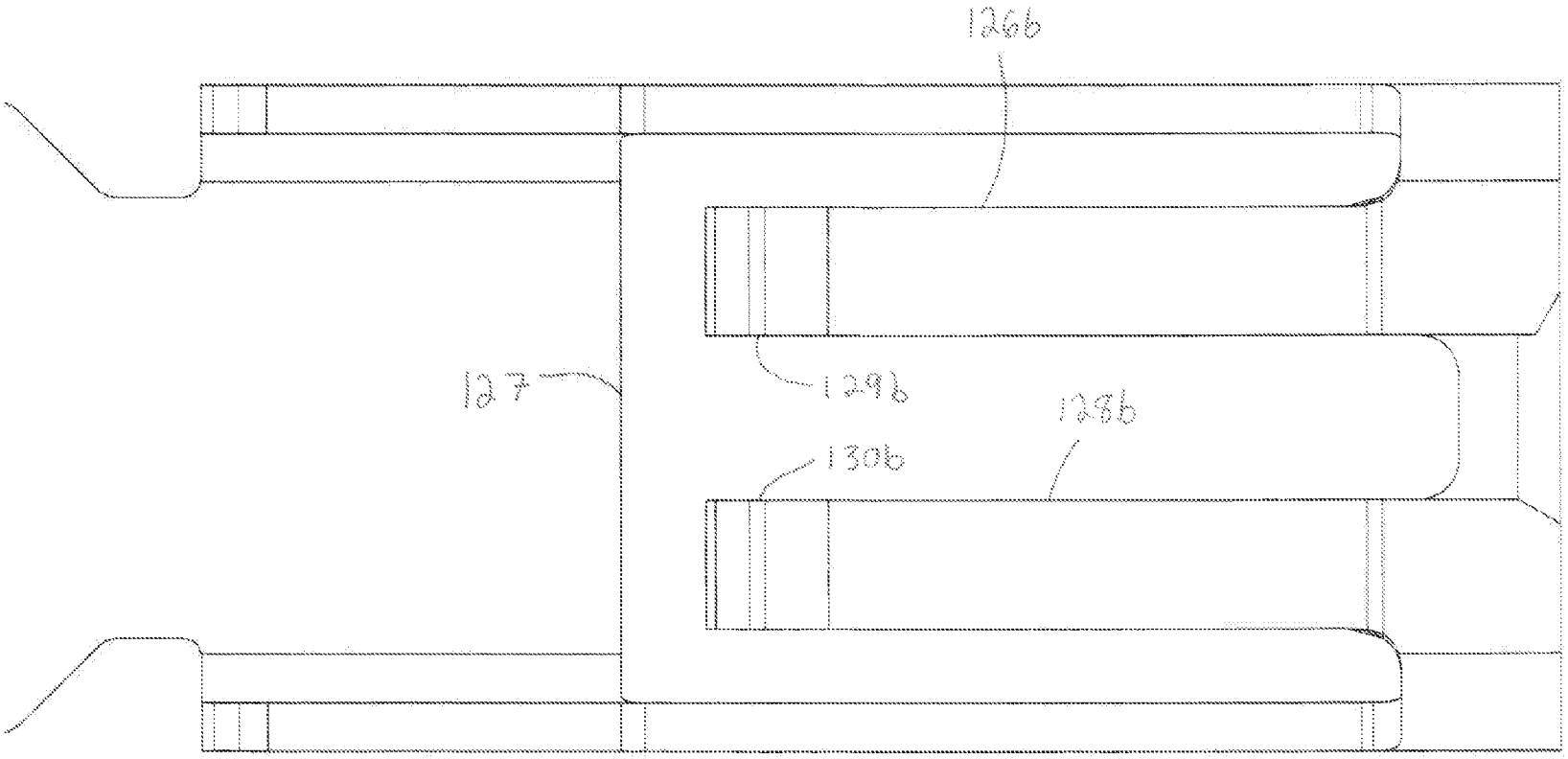
FIG. 17 illustrates a plan view of a section of the end of the terminal depicted in FIG. 16, taken along the line 17-17.
Figure 18:
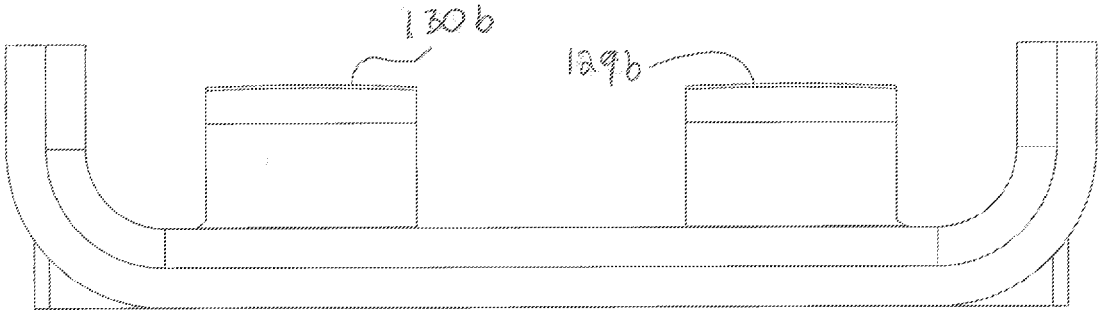
FIG. 18 illustrates an elevated front view of the embodiment depicted in FIG. 17.
Figure 19:
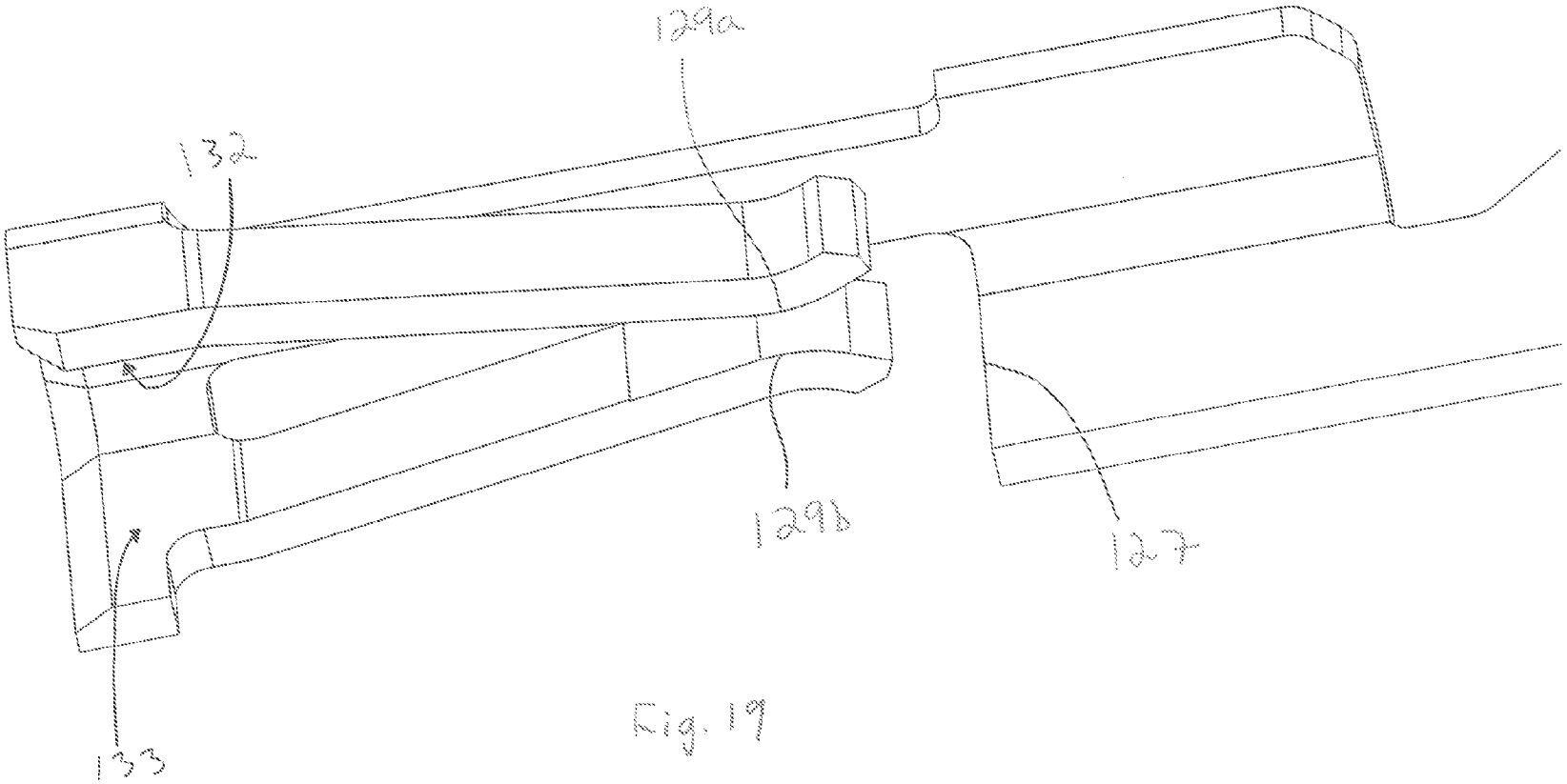
FIG. 19 illustrates a perspective view of a section of the end of the terminal depicted in FIG. 16, taken along the line 19-19.
Figure 20:
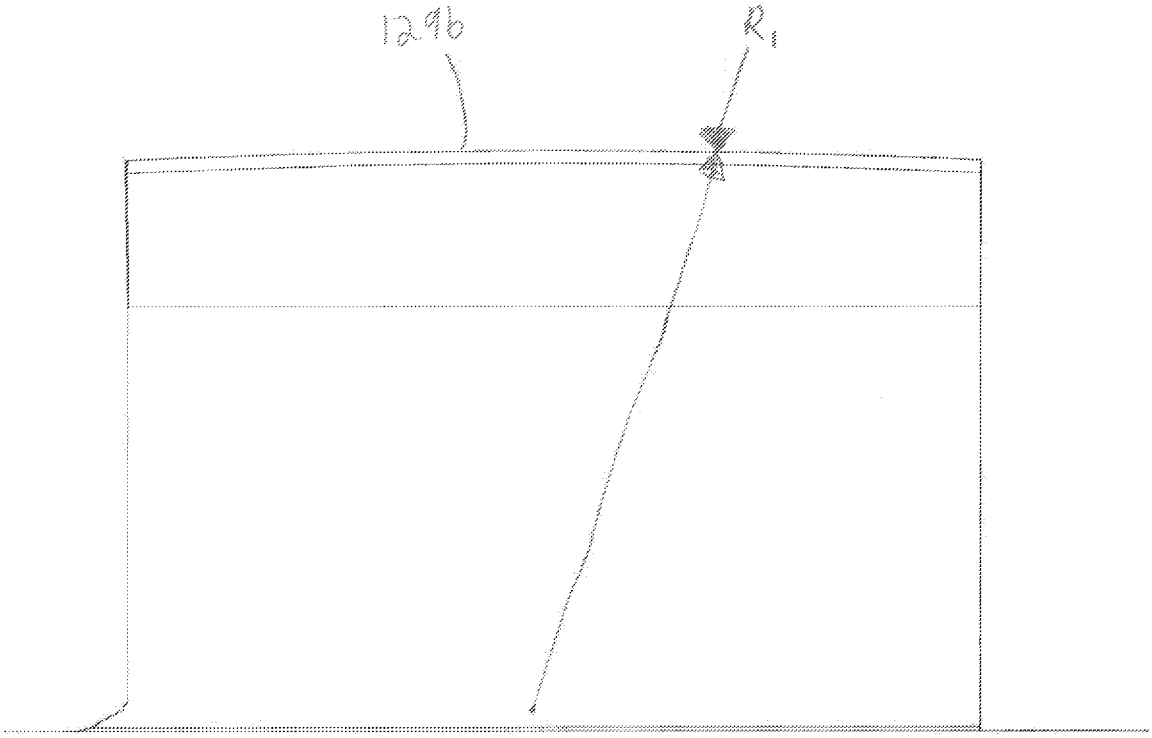
FIG. 20 illustrates an elevated front view of an embodiment of a finger that may be provided on an end of a terminal.
Figure 21:
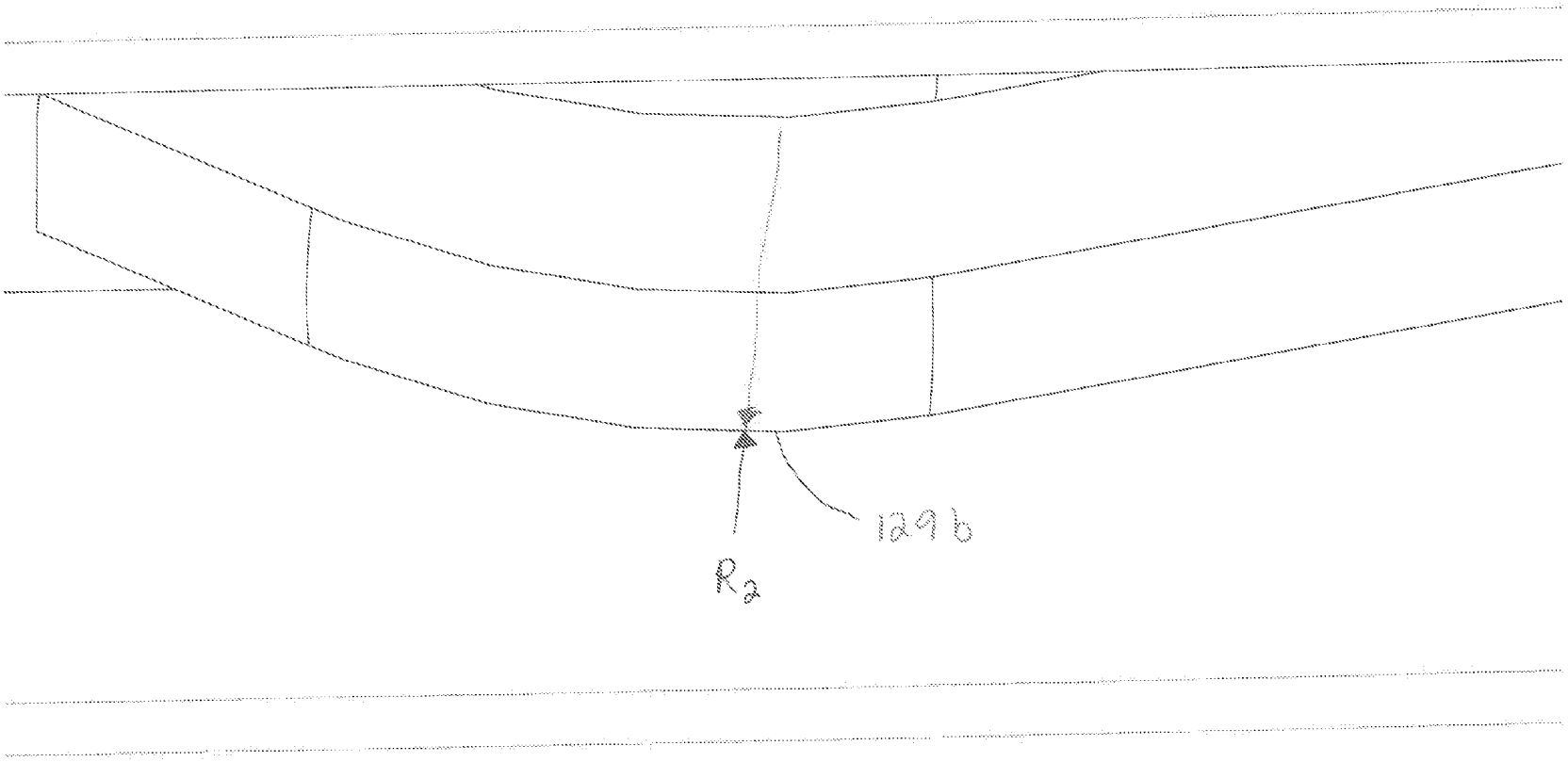
FIG. 21 illustrates an elevated side view of the finger depicted in FIG. 20.

The housing 110 includes halves 111*a*, 111*b* and supports the gasket 105 and includes apertures 115 that receive the contacts 62 of terminals 60. The gasket 105 is position in notch 113 and its position is maintained, in part, by lip 112*a*, 112*b*, which can help to ensure the gasket 105 is not displaced during installation. As can be appreciated from FIG. 13, the half 111*b* supports the terminal 120 in a channel 116 and a body 122 can be positioned in the channel 116 so that it substantially is held in place. Coupling end 125 is configured to engage the corresponding contact 62. As can be appreciated, the coupling end 125 can include multiple fingers 126*a*, 126*b*, 128*a*, 128*b* suitable for translatably engaging contacts. The use of multiple fingers on an end of a terminal increases the number of contact points and thus can increase the reliability of the contact system, as well as helping to ensure that any resistance increase over time is kept below a desirable value. In addition, the use of opposing fingers helps ensure the contact force is balanced on both sides and reduces the potential for deviations in the desired contact force. However, in alternative embodiments some other number of fingers (either less or more) may be used. In addition, the benefits provided by the use of opposing fingers can be traded for a system that does not use plating on both sides of contact 62. It has been found that a terminal end with bifurcated fingers allows for at least two points of contact and is beneficial for systems where the application benefits from a longer operating period (such as more than 10 years).

It should be noted that while the depicted system has the deflecting terminals (e.g., female terminals) on the biscuit 100, this could be reversed such that the receptacle included deflecting contacts and the terminals in the biscuit were stationary. Thus, while the depicted terminal configuration has been determined to provide certain manufacturing efficiencies, the depicted terminal configuration could be reversed if desired and is not intended to be limiting unless otherwise noted. Furthermore, while both sides of the connector that provides the biscuit 100 are substantially configured identically, in alternative embodiments one side could be configured differently that the other. Thus, it should be appreciated that the terminal and the housing configuration could be altered between a male and female orientation. Consequentially, while the depicted orientation is male/female (male housing and female terminal configuration) on each end, each end could also be male/male, female/female and female/male. The advantage of the depicted configuration is that the biscuit 100 can be inserted into the receptacle without concern for its orientation (e.g., it could be rotated 180 degrees and/or flip over and still be installed).

The terminal 120 can be shaped in a blanked and formed process and includes an aperture 127 in which fingers 126*b*, 128*b* can be formed from and the aperture 127 allows the fingers 126*b*, 128*b* to deflect downward when the fingers 126*b*, 128*b* engage the contact 62. This configuration of the terminal 120 can help provide a lower profile biscuit 100 while helping to keep the normal force consistent (it avoids a spike in normal force that might be caused by the terminal bottoming out if the aperture was not provided), which in certain applications may prove advantageous. The terminal 120 also includes an opening 124*a*, 124*b*, defined by an edge 133, a shoulder 132 and two walls 131, that is designed to allow the contact 62 to be inserted therein so as to engage the fingers and includes a notch 134.

Each of the fingers 126*a*, 126*b*, 128*a*, 128*b* includes a mating surface 129*a*, 129*b*, 130*a*, 130*b*, respectively, that engages the contact 62. The mating surface of the respective finger engages the contact 62 and in certain embodiments the mating surface can press against the contact with a normal force of less than 150 grams and in certain embodiments can be less than 100 grams. Thus, compared to convention system, in certain embodiments of the depicted system the terminals can provide low resistance while using a relatively low normal force. For certain applications, the lower normal force can help reduce the amount of plating that is displaced during cycles of macro motion.

As can be appreciated, in an embodiment the mating surface can provide a first radius R1 (from edge to edge of the mating surface) which can be about 3.5 mm and a second radius R2 (from the front to the rear of the mating surface), which can be about 1 mm. The first radius R1 is larger than the second radius R2 and in an embodiment the first radius R1 is at least twice the second radius R2. This allows for sufficient surface area so as to avoid high pressure between the opposing finger and contact and provides a spherical/egg shape on a flat surface. As can be appreciated, in certain embodiments the depicted terminal shape in combination with suitable lubrication and surface material construction, allows for a system that is capable of providing reliable electrical connection in a system that undergoes a large number of cycles of macro motion. In an embodiment, the shape and construction of the terminal and finger can be such that the Hertzian stress is less than 800 MegaPascal and preferably is less than 750 MegaPascal and in exemplary embodiments can range between 720 and 700 MegaPascal.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A energy transfer system, comprising:

a first panel supporting a first header with a first terminal and a second header with a second terminal, the first and second headers being on opposing sides of the first panel;

a second panel supporting a third header with a third terminal, wherein the first panel and the second panel are configured to be mounted adjacent each other; and a connector with a first end and a second end, the first end configured to mate with the first header and the second end configured to mate with the third header, the connector including a fourth terminal configured to electrically couple the first and third terminals, wherein the first, third and fourth terminals are configured to provide a resistance between the first and third terminals that increases less than 20 milliohms after 5000 cycles of macro motion between the first and second panels.

2. The energy transfer system of claim 1, wherein the starting resistance is less than about 10 milliohms.

3. The energy transfer system of claim 1, wherein the resistance increase less than 20 milliohms over 7000 macro cycles.

4. The energy transfer system of claim 1, wherein the resistance increases less than 20 milliohms over 15000 macro cycles.

5. The energy transfer system of claim 1, wherein the macro motion is at least 0.50 mm.

6. The energy transfer system of claim 1, wherein the macro motion is at least 1.0 mm.

7. The energy transfer system of claim 1, wherein each macro motion cycle occurs during a temperature change that is an average of at least 30 C.

8. The energy transfer system of claim 7, wherein the temperature change is an average of at least 40 C.

9. The energy transfer system of claim 1, wherein the resistance increase is less than 10 milliohms.

10. The energy transfer system of claim 1, wherein the fourth terminal includes a first end and a second end that each include bifurcated fingers, the bifurcated fingers configured to engage opposing sides of the corresponding first and third terminals.

11. An energy transfer system, comprising:

a first panel configured for securely mounting on a base and including a first header with a first pair of terminals and a second header with a second pair of terminals, the first and second headers being on opposing sides of the first panel, the first panel having a first coefficient of thermal expansion;

a second panel configured for securely mounting on the base and including a third header with a third pair of terminals, the second panel having a second coefficient of thermal expansion, the first and second coefficients of thermal expansion being configured such that when the first and second panels are secured to the base adjacent each other, the first header and the second header will vary at least 0.25 mm in response to a temperature variation of 30 degrees C.; and a connector configured to mate to the first header and the second header, the connector including a fourth pair of terminals configured to respectively electrically couple the first and third pairs of terminals, each terminal of the fourth pair of terminals configured to provide a resistance between the corresponding terminals of the first and third pairs of terminals that is less than 30 milliohms after at least 5000 cycles of macro motion.

12. The energy transfer system of claim 11, wherein the first, third and fourth pairs of terminals are configured so that the resistance is less than 30 milliohms after at least 7000 cycles of macro motion.

13. The energy transfer system of claim 11, wherein the terminals are configured so that the resistance is less than 20 milliohms after at least 10000 cycles.

14. The energy transfer system of claim 11, wherein at least one of the pairs of terminals is configured to provide at least 0.50 mm of wipe.

15. The energy transfer system of claim 11, wherein each terminal of the fourth pair of terminals has a first and second end, the first and second ends each having multiple fingers.

16. The energy transfer system of claim 15, wherein the multiple fingers are configured to engage opposing sides of corresponding first and third pairs of terminals.

17. The energy transfer system of claim 15, wherein each of the fingers has a mating surface with a first radius extending between edges of the finger and a second radius in a direction of translation during macro motion, the first radius being greater than the second radius.

18. The energy transfer system of claim 15, wherein each finger presses on a corresponding surface of the terminals of the first and second pairs of terminals with a force that is less than 100 grams.

19. The energy transfer system of claim 11, wherein one of the first pair of terminals and the fourth pair of terminals includes an end with bifurcated fingers and each finger presses on a corresponding surface of the other terminals with a force that is less than 100 grams.

20. The energy transfer system of claim 19, wherein the end includes two sets of opposing fingers.

21. The energy transfer system of claim 11, wherein each of the first and second panels includes a solar conversion region.

* * * * *